US011330881B2

(12) United States Patent
Eaton

(10) Patent No.: US 11,330,881 B2
(45) Date of Patent: May 17, 2022

(54) SYSTEM FOR HOLDING MULTIPLE OBJECTS

(71) Applicant: Cheryl Kalista Eaton, Redondo Beach, CA (US)

(72) Inventor: Cheryl Kalista Eaton, Redondo Beach, CA (US)

( * ) Notice: Subject to any disclaimer, the term of this patent is extended or adjusted under 35 U.S.C. 154(b) by 427 days.

(21) Appl. No.: 16/352,493

(22) Filed: Mar. 13, 2019

(65) Prior Publication Data

US 2019/0281938 A1 Sep. 19, 2019

Related U.S. Application Data

(60) Provisional application No. 62/642,489, filed on Mar. 13, 2018.

(51) Int. Cl.

| | |
|---|---|
| ***A45C 13/02*** | (2006.01) |
| ***A45C 13/10*** | (2006.01) |
| ***A45C 3/06*** | (2006.01) |
| ***A45C 7/00*** | (2006.01) |

(52) U.S. Cl.

CPC ..... *A45C 13/02* (2013.01); *A45C 3/06* (2013.01); *A45C 7/0077* (2013.01); *A45C 13/10* (2013.01); *A45C 2013/026* (2013.01); *A45C 2013/1015* (2013.01)

(58) Field of Classification Search

CPC ..... A45C 13/02; A45C 3/06; A45C 7/0077; A45C 13/10; A45C 2013/026; A45C 2013/1015

See application file for complete search history.

(56) References Cited

U.S. PATENT DOCUMENTS

| | | | | | |
|---|---|---|---|---|---|
| 1,155,581 | A * | 10/1915 | Kaiser | B65D 73/02 | 206/479 |
| 1,437,359 | A * | 11/1922 | Reed | A61F 17/00 | 206/479 |
| 1,703,132 | A * | 2/1929 | Acheson | A45C 13/02 | 206/8 |
| 5,163,914 | A * | 11/1992 | Abel | A61M 25/02 | 128/200.24 |
| 5,174,447 | A * | 12/1992 | Fleming | B25H 3/00 | 206/373 |
| 5,337,907 | A * | 8/1994 | McKenzie | A45F 3/00 | 206/427 |
| 6,065,659 | A * | 5/2000 | Faz | A45C 11/26 | 206/570 |

(Continued)

*Primary Examiner* — Tri M Mai

(74) *Attorney, Agent, or Firm* — Cislo & Thomas, LLP; Katherine B. Sales

(57) ABSTRACT

A system for holding multiple objects, the system comprising a sheet of flexible sheet of material having a front surface, a back surface, and a longitudinal axis, one or more undulating straps coupled to the front surface of the sheet of material, each strap having a longitudinal axis that is parallel to the longitudinal axis of the sheet of material, wherein the undulation creates a plurality of humps and valleys, each hump forming a slot for receiving and retaining an object therein, one or more fasteners for coupling the straps to the sheet material, wherein the fasteners are disposed within the valleys of the undulating straps, and one or more removable coupling means comprising hook and loop fasteners coupled to the back surface of the sheet of material.

14 Claims, 4 Drawing Sheets

(56) References Cited

U.S. PATENT DOCUMENTS

| | | | | |
|---|---|---|---|---|
| 6,098,558 | A * | 8/2000 | Baird | B25F 5/029 112/413 |
| 7,017,590 | B2 * | 3/2006 | Mackinder | A45C 11/26 132/233 |
| 7,694,823 | B2 * | 4/2010 | Fontanesi | A47J 47/16 206/576 |
| D699,030 | S * | 2/2014 | Etzler | B25H 3/00 D3/206 |
| 8,785,778 | B2 * | 7/2014 | Streeter | A45F 5/00 174/72 A |
| 8,875,883 | B2 * | 11/2014 | Kinskey | B25H 3/021 206/373 |
| 9,597,789 | B2 * | 3/2017 | Yoosefi | A45C 13/30 |
| 2006/0207902 | A1 * | 9/2006 | Frye | A45D 29/20 206/373 |
| 2018/0168307 | A1 * | 6/2018 | Mieck | A45C 5/03 |

* cited by examiner

SYSTEM FOR HOLDING MULTIPLE OBJECTS

CROSS-REFERENCE TO RELATED APPLICATIONS

This application claims priority to U.S. Provisional Application No. 62/642,489, titled "System for Holding Multiple Objects," filed Mar. 13, 2018, the contents of which are incorporated herein by reference in their entirety.

BACKGROUND

Many people have the desire to carry multiple objects. However, when these multiple objects are placed into a purse, handbag, or travel bag, the objects tend to fall to the bottom of the bag making them difficult to retrieve. Also, when the objects are bottles filled with a liquid, there is always the chance the bottles will leak if not kept upright.

Accordingly, there is a need for an improved system for holding multiple objects.

SUMMARY

In a first embodiment, the present invention is directed to a system for holding multiple objects. The system comprises a top sheet of flexible sheet of material and a bottom sheet of flexible material, one or more undulating straps coupled to the front surface of the top sheet of material, one or more lengths of elastic material coupled to the front surface of the top sheet of material, one or more fasteners for coupling the straps and the lengths of elastic material to the top sheet material, and one or more removable coupling means comprising hook and loop fasteners coupled to the back surface of the bottom sheet of material.

Both the top and bottom sheets have a front surface, a back surface, a longitudinal axis, a vertical axis, and a periphery. The back surface of the top sheet of material is proximate the front surface of the bottom sheet of material and the top and bottom sheets of material are coupled together along their peripheries.

Each of the straps have a longitudinal axis that is parallel to the longitudinal axis of the top sheet of material, wherein the undulation creates a plurality of humps and valleys, each hump forming a slot for receiving and retaining an object therein;

The lengths of elastic material extend parallel to the straps, below the straps.

The fasteners are disposed within the valleys of the undulating straps.

In a second embodiment, the present invention is directed to a system for holding multiple objects, wherein the system comprises a sheet of flexible sheet of material; one or more undulating straps coupled to the front surface of the sheet of material, one or more fasteners for coupling the straps to the sheet material, and one or more removable coupling means comprising hook and loop fasteners coupled to the back surface of the sheet of material.

In a third embodiment, the present invention is directed to a system for holding multiple objects, the system comprising a sheet of flexible sheet of material, one or more undulating straps coupled to the front surface of the sheet of material, one or more fasteners for coupling the straps to the sheet material, one or more removable coupling means comprising hook and loop fasteners coupled to the back surface of the sheet of material, and a bag having an inside surface, wherein the sheet of flexible material is removably coupled thereto.

Optionally, the system can further comprise a length of material coupled to the back surface of the bottom sheet configured to secure the system in rolled-up configuration.

Optionally, each strap has two opposed ends and each of the two opposed ends of each strap is secured to the periphery of the top sheet.

Optionally, the fasteners permanently couple the straps to the top sheet.

Optionally, the fasteners removably couple the straps to the top sheet to allow a user to change the size of the humps/slots.

Optionally, the system can further comprise one or more objects retained within the slots, and the one or more objects can be essential oil bottles.

Optionally, each strap can comprise a pair of straps that extend parallel to each other, proximate to each other, such that together they form a single, undulating strap.

Optionally, the system comprises two straps that extend parallel to each other and are spaced apart from each other, such that two separate rows of humps and valleys are formed.

Optionally, the bag is a purse.

In a fourth embodiment, the present invention is directed to a method of using the system. The method comprises the steps of: a) providing the system; and b) inserting one or more objects into the slots.

In a fifth embodiment, the present invention is directed to a method of using the system, the method comprising the steps of a) providing the system, b) removably coupling the sheet of material to the inside surface of the bag, and c) inserting one or more objects into the slots.

Optionally, step c) is performed before step b).

DRAWINGS

These and other features, aspects, and advantages of the present invention will become better understood with reference to the following description, appended claims, and accompanying drawings where:

DESCRIPTION

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

Figure 1:
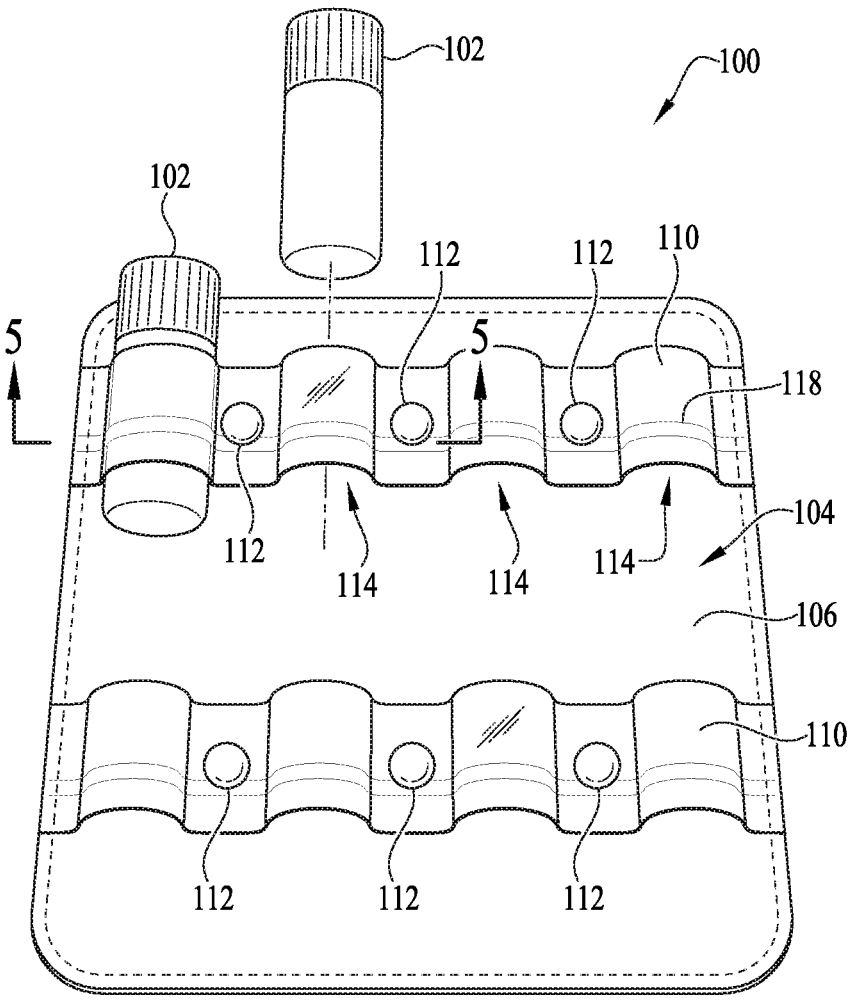
FIG. 1 is a perspective view of a first embodiment of a system for holding objects having features of the present invention.
Figure 2:
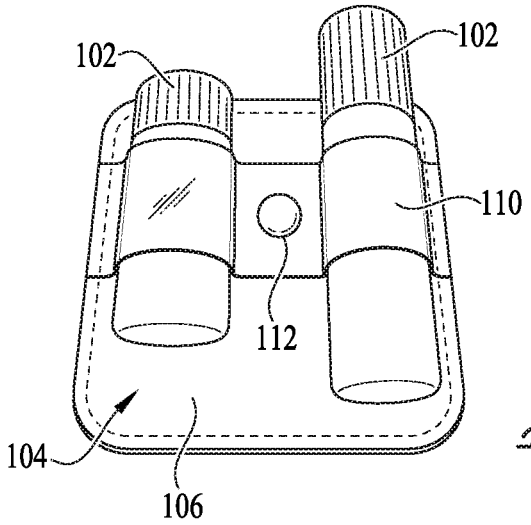
FIG. 2 is a perspective view of a second embodiment of a system for holding objects, having features of the present invention.

Referring now to FIGS. 1 and 2, there is shown a system 100 for holding multiple objects 102. The system 100 comprises at least one flexible sheet of material 104. Optionally, the system 100 can comprise two sheets of material 104, a top sheet 104A and a bottom sheet 104B, coupled together around their peripheries by stitching or the like. Each sheet 104 has a front surface 106 and a back surface 108. In the event only one sheet 104 is used, one or more straps 110 are coupled to the front surface 106 of the single flexible sheet of material 104. In the event two sheets 104 are used, one or more straps 110 are coupled to the front surface 106 of the top sheet 104A. The sheets 104 have a longitudinal axis and a vertical axis. The sheets 104 can be made from leather, faux leather, a flexible plastic material, such as PVC (polyvinyl chloride), nylon, polyester, a flexible acrylic, or cloth made from an animal source (wool, silk) or plant source (cotton, flax). The sheets 104 can have any dimensions, depending on the number of objects 102 the system 100 is to hold. Each sheet 104 can have a length of from about 3 inches to about 12 inches, a width of from about 3 inches to about 12 inches, and a thickness of from about ⅛ inch to about ½ inch. Optionally, the sheet 104 is not flexible, and is instead rigid, in the event a user desires a more rigid structure for securing objects 102.

Figure 7:
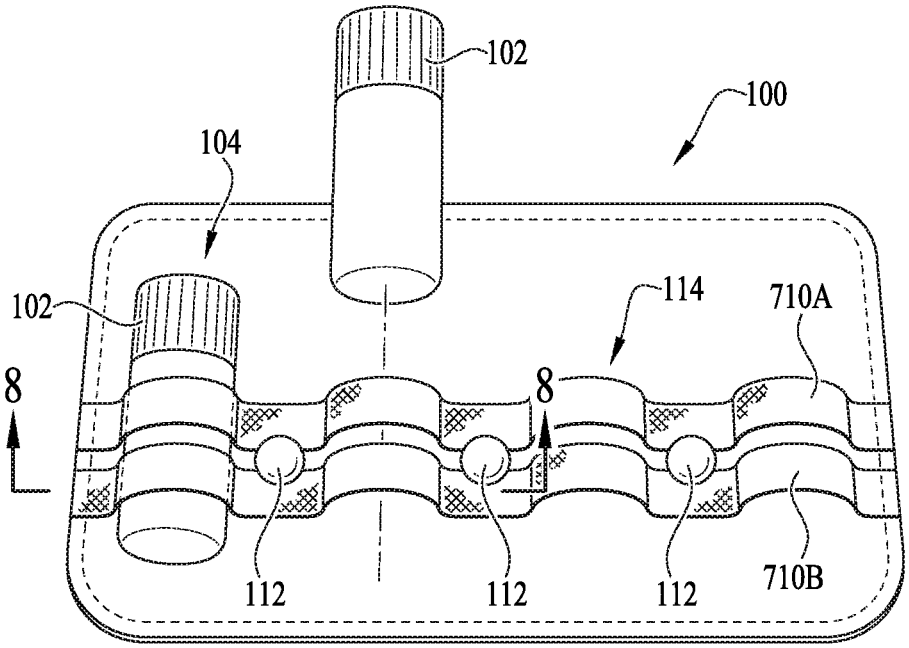
FIG. 7 is a top perspective view of a third embodiment of a system for holding objects, having features of the present invention.

The one or more straps 110 each have a longitudinal axis and can be made from leather, faux leather, a flexible plastic material, such as PVC (polyvinyl chloride), nylon, polyester, a flexible acrylic, or cloth made from an animal source (wool, silk) or plant source (cotton, flax). The straps HO extend along the top sheet 104A such that the longitudinal axis of each strap 110 is parallel to the longitudinal axis of the top sheet 104A. Optionally, as shown in FIG. 7, instead of each row comprising a single strap, each row comprises a pair of straps 710A, 710B.

The straps 110 are coupled to the top sheet 104A by a plurality of fasteners 112, spaced approximately 1 inch to 4 inches apart from each other along the length of the sheet 104. As shown in the Figures, this spacing secures the straps 110 in an undulating pattern, creating a plurality of humps 114, where each hump 114 forms a slot 116 for receiving and retaining an object 102. Typically, each hump 114 has a width of from about 1 inch to about 3 inches, and a height of from about 1 inch to about 3 inches. Preferably, each hump 114 has a width of 1 inch and a height of from about 1 inch to about 2 inches. The height of each hump 114 is the distance that the apex of the hump 114 is from the sheet 104 below. Optionally, each end of each strap 110 is also coupled to the perimeter of the sheet 104 by stitching that runs along the perimeter of the sheet 104.

Figure 5:
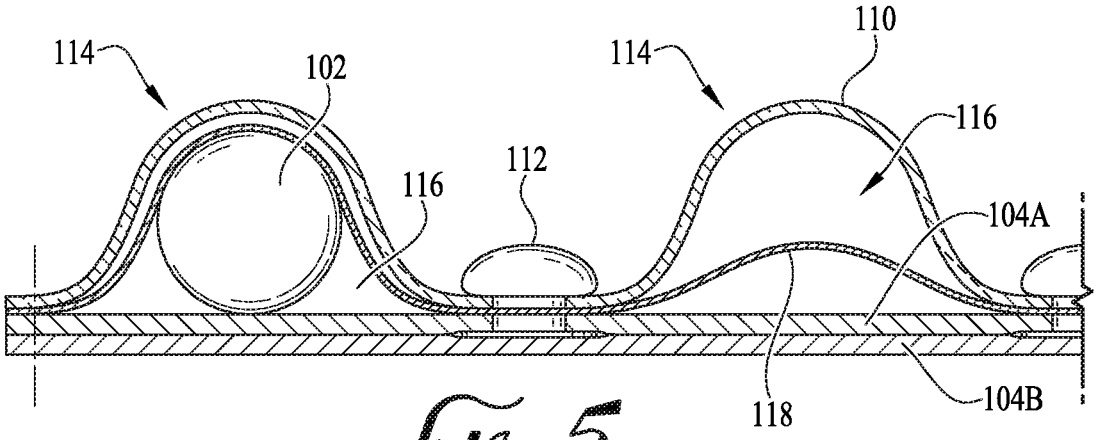
FIG. 5 is a sectional view of the system of FIG. 1, taken along line 5-5.

As best shown in FIG. 5, the system 100 can further comprise one or more lengths of elastic material 118 coupled to the front surface 106 of the sheet 104. Preferably, the lengths of elastic material 118 run parallel with the straps 110, below the straps 110, between the straps 110 and the front surface 106 of the sheet 104. The lengths of elastic material 118 can help secure larger objects 104 that are retained in the slots 116. Typically, the lengths of elastic material 118 can be secured in multiple places to the sheet 104 using the fasteners 112, which extend through the straps 110, through the elastic material 118 and into the sheet 104. Optionally, the ends of the lengths of elastic material 118 are secured to the periphery of the sheet 104 by the same stitching that secures the top and bottom sheets 104A, 104B to each other. Optionally, the lengths of elastic material 118 comprise braided elastic, and when secured, the elastic material 118 forms humps having a height of about 0.25 inches and a width of about 2 inches. FIG. 7 shows an embodiment wherein the system 100 does not comprise one or more lengths of elastic material 118.

Figure 8:
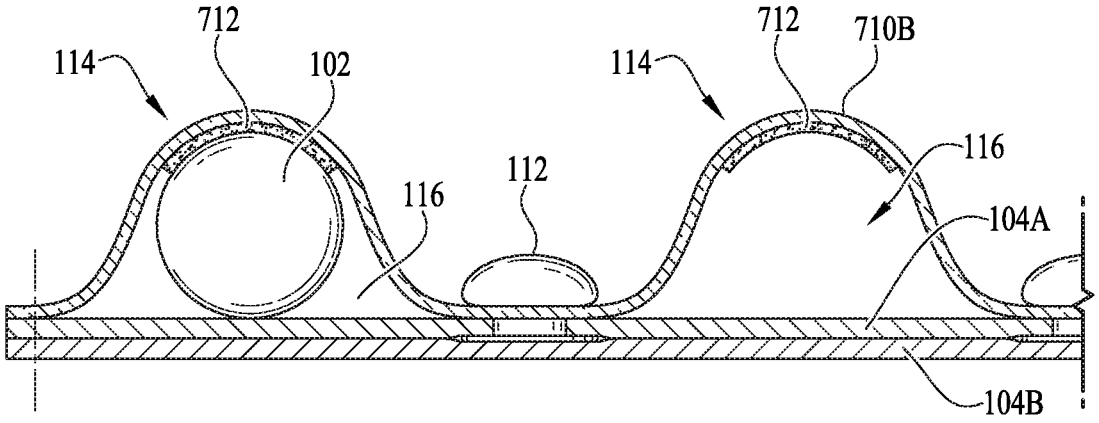
FIG. 8 is a bottom plan view of the system of FIG. 7.

Optionally, shown in FIG. 8, the straps 110 can comprise a non-slip adhesive 712 coupled to an interior surface thereof, in order to provided added grip on the inside of the humps 114 for gripping objects placed therein. The non-slip adhesive 712 can be sticky, or tacky, or non-sticky, and can be made from silicone, rubber or plastic.

The fasteners 112 can permanently secure the straps 110, or removeably secure the straps 110, and can include but are not limited to: rivets, grommets, magnets, stitching, buttons, toggles or snaps. In the event the fasteners 112 removably secure the straps 110 (for example, buttons, toggles, or snaps) the size of the humps 114 created by the straps 110 can be adjusted as desired by the user. For example, if a larger object 102 needed to be restrained, the user can uncouple one or more of the fasteners 112 and re-secure them at a different point, creating a larger hump 114.

Figure 3:
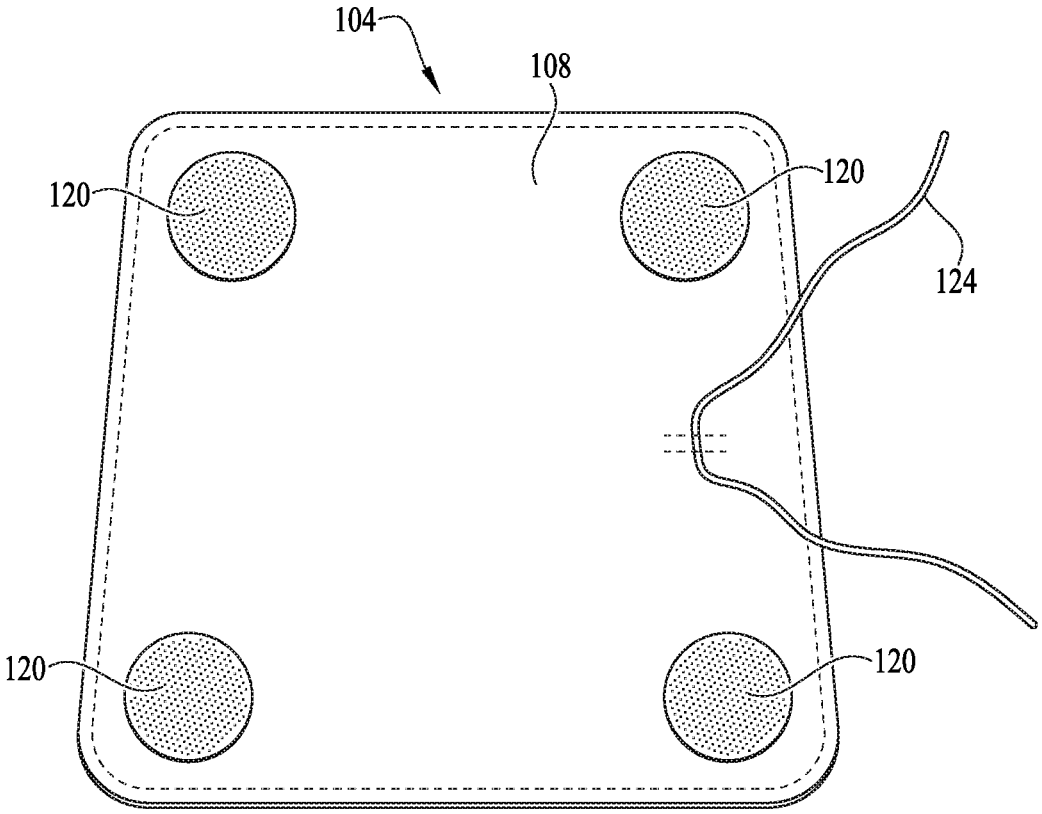
FIG. 3 is a top plan view of the back of the system according to FIG. 1.
Figure 4:
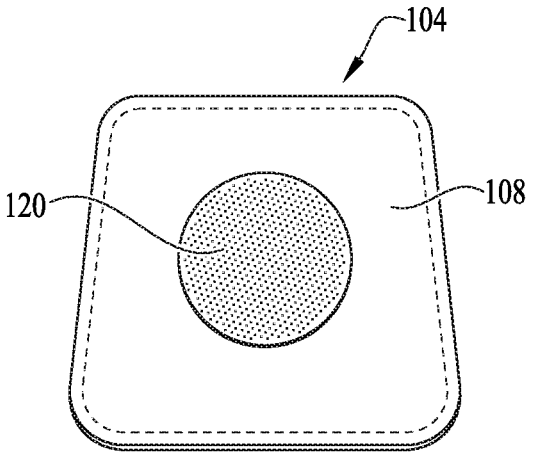
FIG. 4 is a top plan view of the back of the system according to FIG. 2.

Referring now to FIGS. 3 and 4, the system 100 can further comprise one or more removable coupling means 120 for removably securing the system 100 to a surface. The removable coupling means 120 can be coupled to the back surface 108 of the sheet 104. For example, the removable coupling means 120 can comprise hook and loop fasteners. As shown in FIG. 3, there are four removable coupling means 120 coupled to the back surface 108, but there can be less than four (as shown in FIG. 4) or more than four removable coupling means. If the system 100 has smaller dimensions, four removable coupling means 120 may not be necessary to secure the system 100.

Figure 6:
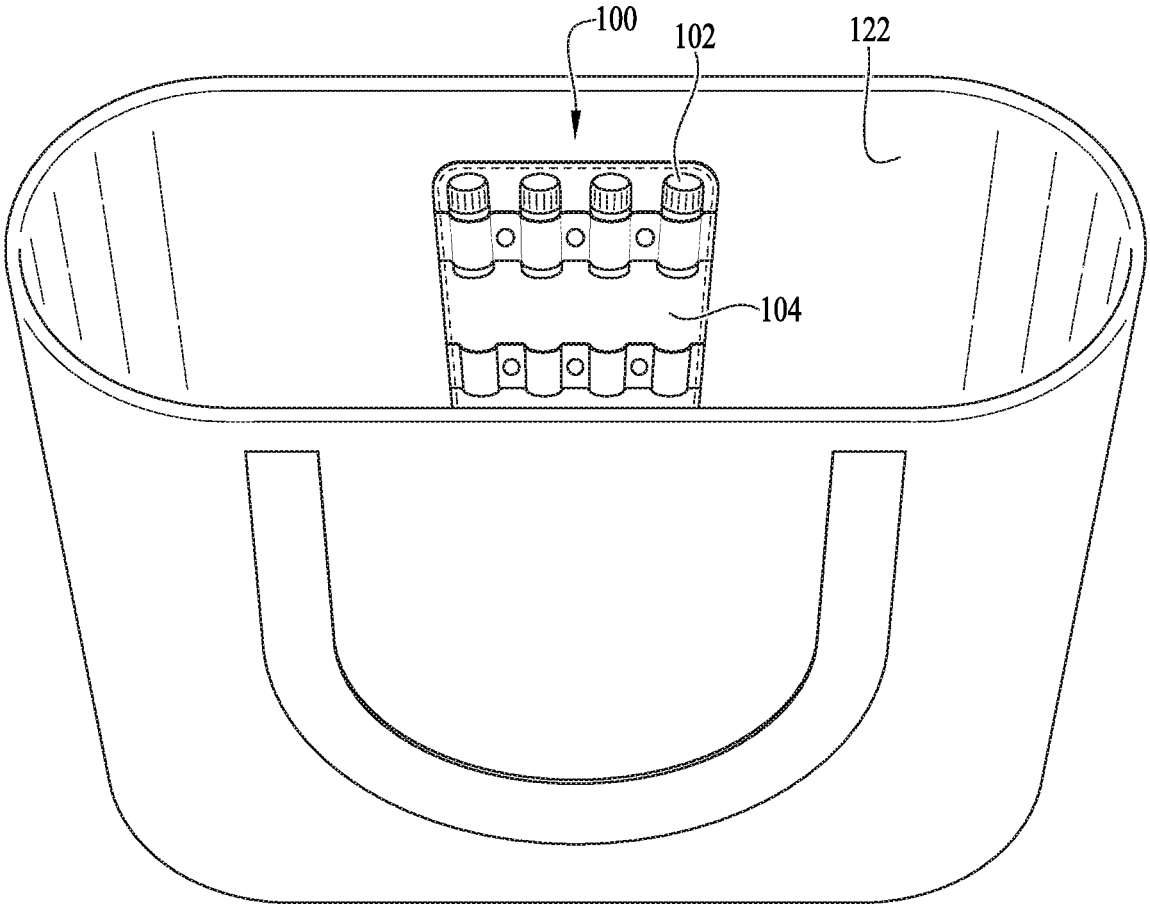
FIG. 6 is a top perspective view of the system of FIG. 1, mounted inside a carrying bag.

The system 100 can utilize the removable coupling means 120 to removably couple to any surface. As shown in FIG. 6, utilizing the removable coupling means 120 allows a user to secure the system 100 to the inside of a handbag 122, for example. This keeps the system 100 upright, keepings its objects 102 upright and within easy reach of the user. Optionally, the system 100 can be secured to wall or mirror in a bathroom, for example if the system 100 were to hold makeup utensils or other products. Optionally, the system 100 can utilize non-removable means for coupling to surface. Such non-removable means can comprise adhesive strips or patches that adhere the system 100 to a wall surface for example.

Optionally, as shown in FIG. 3, the system 100 can further comprise a length of material 124 coupled to the back surface 108 of the system 100. The length of material 124 can include but is not limited to string, small rope, rawhide tie, ribbon, or elastic loop. The length of material 124 allows a user to roll the system 100 up, wrapping the flexible sheet 104 around its objects 102, and secure the system 100 in a compact roll. In the event the user it traveling and the bag they are using does not have the removable coupling means 120 already attached inside, the user still has the ability to secure the objects 102 held by the system 100 by rolling the system 100 up.

The system 100 can be used to hold many different objects 102, including but not limited to essential oil bottles, mascara bottles, makeup brushes, etc. A problem with essential oil bottles is that because the contents are liquid, the bottles can leak. Accordingly, it is important to keep the bottles oriented upright when traveling. As shown in FIG. 6, the system 100 can be removeably attached to the inside of a purse or travel bag 124. This placement as several advantages including that it keeps the bottles securely upright, and within easy reach of the user. The user does not have to go digging through their purse or bag 124 to find the small oil bottles buried at the bottom under other items.

A method of using the system 100 comprises removably securing the system 100 to an inside surface of a purse, handbag or travel bag 124, and then placing one or more objects 102 in the slots 116. Optionally, the one or more objects 102 can be placed in the slots 116 first, and then the system 100 is secured to the inside surface of a purse, handbag or travel bag 124.

Although the invention has been described in terms of a preferred embodiment, nevertheless, changes and modifications can be made which do not depart from the spirit, scope and teachings of the invention. Such changes and modifications are deemed to fall within the purview of the present invention as claimed.

What is claimed is:

1. A system for holding multiple objects, the system comprising:

a) a top sheet of flexible sheet of material having a front surface, a back surface, a longitudinal axis, a vertical axis, and a periphery;

b) a bottom sheet of flexible material having a front surface, a back surface and a periphery, wherein a substantial portion of the back surface of the top sheet of material is in contact with a substantial portion of the front surface of the bottom sheet of material and the top and bottom sheets of material are coupled together along their peripheries;

c) at least one pair of straps coupled to the front surface of the top sheet of material, each strap having a longitudinal axis that is parallel to the longitudinal axis of the top sheet of material, wherein the pair of straps form a plurality of humps and valleys, each hump forming a slot for receiving and retaining an object therein, wherein each of the pair of straps extend parallel to each other, proximate to each other, such that together they form a single, undulating strap along an entire length of the front surface of the top sheet, and each strap has two opposed ends and each of the two opposed ends of each strap is permanently secured to the periphery of the top sheet;

d) a plurality fasteners for coupling the straps to the top sheet of material, wherein the fasteners are disposed within the valleys of the undulating straps and are centrally positioned between the pair of straps such that the pair of straps are coupled to the top sheet of material by the same plurality of fasteners;

e) one or more removable coupling means comprising hook and loop fasteners coupled to the back surface of the bottom sheet of material for removably coupling to the system to a separate surface that is not the system itself; and f) non-slip adhesive coupled to an interior surface of each of the pair of straps for gripping the object in the slot.

2. The system of claim 1, further comprising a length of material coupled to the back surface of the bottom sheet configured to secure the system in rolled-up configuration.

3. The system of claim 1, wherein the fasteners permanently couple the straps to the top sheet.

4. The system of claim 1, wherein the fasteners removably couple the straps to the top sheet to allow a user to change the size of the humps/slots.

5. The system of claim 1, wherein the one or more objects are essential oil bottles.

6. The system of claim 1, wherein each fastener comprises a top portion and a base, the top portion positioned above the straps and the front surface of the top sheet, and the base positioned between the back surface of the top sheet and the front surface of the bottom sheet.

7. A system for holding multiple objects, the system comprising:

a) a sheet of flexible sheet of material having a front surface, a back surface, and a longitudinal axis;

b) at least one pair of undulating straps coupled to the front surface of the sheet of material, each strap having a longitudinal axis that is parallel to the longitudinal axis of the sheet of material, wherein the undulation creates a plurality of humps and valleys, each hump forming a slot for receiving and retaining an object therein, wherein each of the pair of straps extend parallel to each other, proximate to each other, such that together they form a single, undulating strap along an entire length of the front surface of the top sheet, and each strap has two opposed ends and each of the two opposed ends of each strap is permanently secured to the periphery of the top sheet;

c) a plurality of fasteners for coupling the straps to the sheet material, wherein the fasteners are disposed within the valleys of the undulating straps;

d) one or more removable coupling means comprising hook and loop fasteners coupled to the back surface of the sheet of material for removably coupling to the system to a separate surface that is not the system itself; and e) non-slip adhesive coupled to an interior surface of each of the pair of straps for gripping the object in the slot.

8. The system of claim 7, further comprising a length of material coupled to the back surface of the bottom sheet configured to secure the system in rolled-up configuration.

9. The system of claim 7, wherein the fasteners permanently couple the straps to the sheet.

10. The system of claim 7, wherein the fasteners removably couple the straps to the sheet to allow a user to change the size of the humps/slots.

11. The system of claim 7, further comprising one or more objects retained within the slots.

12. The system of claim 7, wherein the system comprises two pairs of straps that extend parallel to each other and are spaced apart from each other, such that two separate rows of humps and valleys are formed.

13. The system of claim 7, wherein the one or more objects are essential oil bottles.

14. A method of using the system of claim 7, the method comprising the steps of:

a) providing the system of claim 7; and b) inserting one or more objects into the slots.

* * * * *